US007117825B2

(12) United States Patent
Phillips

(10) Patent No.: US 7,117,825 B2
(45) Date of Patent: Oct. 10, 2006

(54) SYSTEM AND METHOD FOR PREVENTING OVERHEATING OF WATER WITHIN A WATER HEATER TANK

(75) Inventor: Terry G. Phillips, Meridianville, AL (US)

(73) Assignee: Synapse, Inc., Huntsville, AL (US)

( * ) Notice: Subject to any disclaimer, the term of this patent is extended or adjusted under 35 U.S.C. 154(b) by 0 days.

(21) Appl. No.: 11/117,065

(22) Filed: Apr. 28, 2005

(65) Prior Publication Data

US 2006/0013572 A1 Jan. 19, 2006

Related U.S. Application Data

(60) Provisional application No. 60/584,401, filed on Jun. 30, 2004.

(51) Int. Cl.
*F22B 1/28* (2006.01)

(52) U.S. Cl. ..... 122/4 A; 122/504; 219/492

(58) Field of Classification Search ..... 122/4 A, 122/504, 507; 392/463, 464, 441, 453, 451, 392/454; 219/441, 492, 494, 482, 483
See application file for complete search history.

(56) References Cited

U.S. PATENT DOCUMENTS

| | | | | |
|---|---|---|---|---|
| 4,620,667 | A | 11/1986 | Vandermeyden et al. | |
| 5,660,328 | A * | 8/1997 | Momber | 236/20 R |
| 5,968,393 | A | 10/1999 | Demaline | |
| RE37,240 | E | 6/2001 | Moore, Jr. et al. | |
| 6,308,009 | B1 | 10/2001 | Shellenberger et al. | |
| 6,350,967 | B1 | 2/2002 | Scott | |
| 6,374,046 | B1 * | 4/2002 | Bradenbaugh | 392/463 |
| 6,560,409 | B1 | 5/2003 | Troost, IV | |
| 6,649,881 | B1 | 11/2003 | Scott et al. | |
| 2003/0093186 | A1 | 5/2003 | Patterson et al. | |

* cited by examiner

*Primary Examiner*—Gregory Wilson
(74) *Attorney, Agent, or Firm*—Thomas Kayden Horstemeyer & Risley, L.L.P.

(57) ABSTRACT

A water heating system has a tank, a first heating element, a first temperature sensor, and a controller. The first heating element is mounted on the tank, and the controller is electrically coupled to the first temperature sensor. The controller is configured to detect a stacking condition based on the first temperature sensor and to disable the first heating element in response to detection of the stacking condition.

23 Claims, 6 Drawing Sheets

SYSTEM AND METHOD FOR PREVENTING OVERHEATING OF WATER WITHIN A WATER HEATER TANK

CROSS REFERENCE TO RELATED APPLICATION

This application claims priority to U.S. Provisional Application No. 60/584,401, entitled "Apparatus and Method for Fluid Temperature Control," and filed on Jun. 30, 2004, which is incorporated herein by reference.

FIELD OF THE DISCLOSURE

The present disclosure generally relates to electrical hot water heaters. More particularly, the disclosure relates to a system and method for reducing stacking temperatures in a hot water heater.

TECHNICAL BACKGROUND

Devices such as hot water heaters, furnaces, and other appliances commonly include one or more heating elements that are controlled by a controller such as a thermostat. A heating element is activated (i.e., placed in an on-state) when heat is needed and deactivated (i.e., turned to an off-state) when heat is not required. The change of states normally occurs when a control signal turns a power relay on or off. Power relays have a pair of contacts capable of meeting the current requirements of the heating element. In a typical home-use hot water heater, approximately 220 volts AC is placed across the heating element and a current of about 10 to 20 amperes flows.

A heating element is typically associated with an upper temperature threshold, referred to as the "upper set point," and a lower temperature threshold, referred to as the "lower set point," that are used for control of the heating element. When the temperature of water in a tank exceeds the upper set point, as measured by a thermal sensor mounted on a wall of the water heater, the heating element is deactivated, and heating of the water by the heating element stops. If the water temperature drops below the lower set point, the heating element is activated and, therefore, begins to heat the water. As heated water is repeatedly withdrawn from the water tank and replenished with cold water, the heating element goes through activation/deactivation cycles.

One problem associated with water heaters is "stacking" wherein water in the upper section of the tank reaches high temperatures that are significantly greater than the upper set point and often much higher than expected by a user. Because a hot water supply pipe of a water tank typically draws water from the top of the tank, stacking may cause the water drawn from the tank to significantly exceed the upper set point. Such an undesired effect can result in pain or injury to a user that touches the overheated water coming from the hot water supply pipe.

Thermal lag can also cause water within the tank to become overheated. "Thermal lag," as used herein, refers to a delay in the temperature of the water reaching the upper set point and a detection by the thermal sensor that the upper threshold has been reached. Thermal lag can cause water temperature to overshoot the upper set point value and, therefore, reach undesirably high levels. Hence, there is a need for reducing undesirable overheating of water within a water heater due to stacking and thermal lag.

SUMMARY OF DISCLOSURE

Generally, the present disclosure pertains to water heating systems and methods capable of automatically preventing water from becoming overheated due to a variety of causes, such as stacking and thermal lag.

A water heating system in accordance with one exemplary embodiment of the present disclosure comprises a tank, a first heating element, a first temperature sensor, and a controller. The first heating element is mounted on the tank, and the controller is electrically coupled to the first temperature sensor. The controller is configured to detect a stacking condition based on the first temperature sensor and to disable the first heating element in response to detection of the stacking condition.

A method in accordance with one exemplary embodiment of the present disclosure comprises the steps of: sensing a temperature via a first temperature sensor mounted on a tank; disabling a first heating element mounted on the tank based on whether the temperature exceeds a threshold; and deactivating the first heating element based on a second temperature sensor mounted on the tank.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

Figure 1:
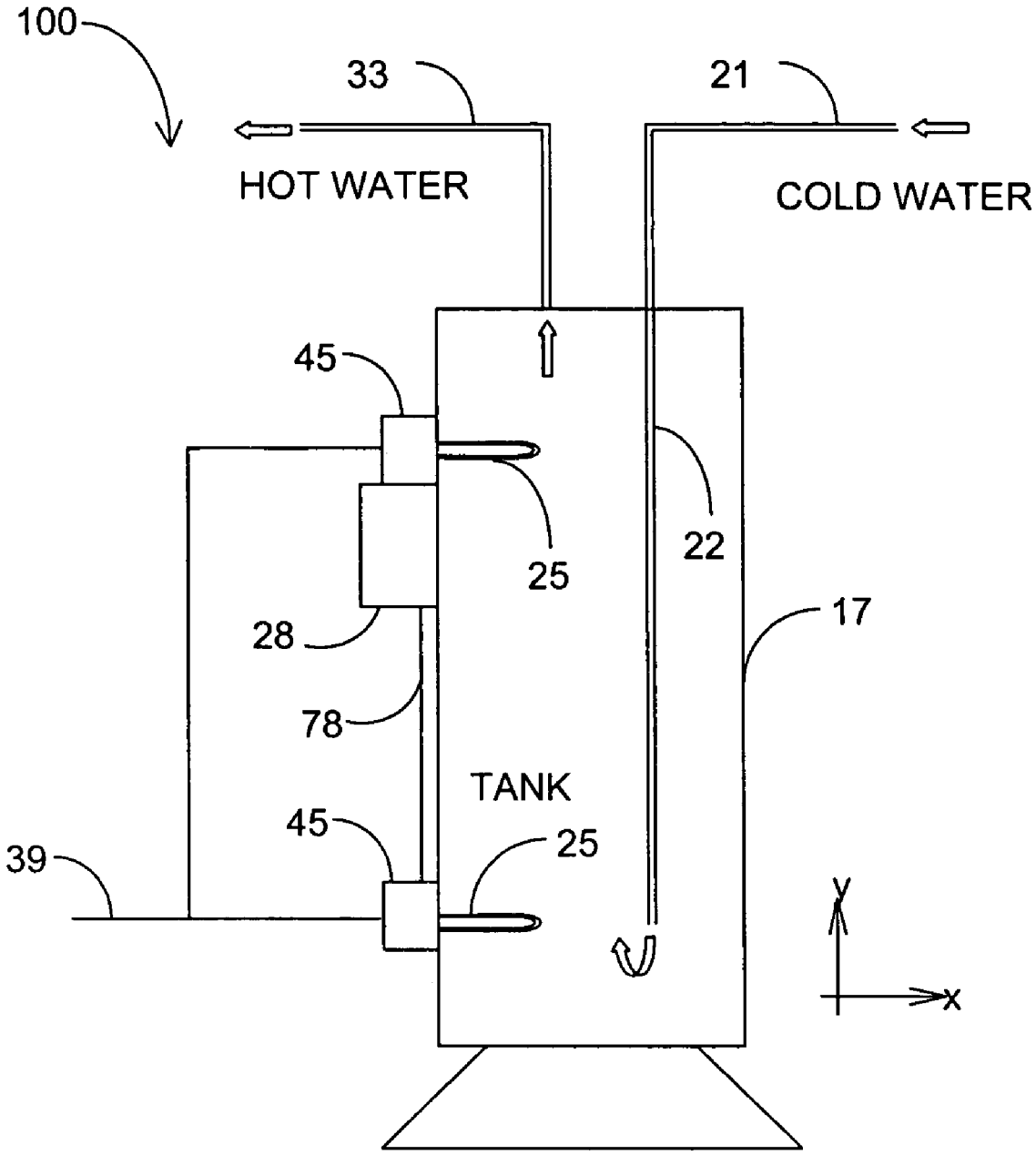
FIG. 1 illustrates an exemplary embodiment of a water heating system.

Reference will now be made in detail to embodiments of the disclosure, examples of which are illustrated in the accompanying figures. Wherever possible, the same reference numerals will be used throughout the drawing figures to refer to the same or like parts.

Generally, and as depicted in FIG. 1, a water heating system 100 has a controller 28 and at least one relay 45 for applying electrical power to at least one heating element 25 located within a water tank 17. Cold water is supplied to the water tank 17 by cold water pipe 21, and the cold water flows down (in the negative y direction) a filler tube 22 into the bottom section of the tank. Hot water is drawn (exits to a user) out of the upper section of the tank through hot water pipe 33. Note that FIG. 1 depicts two heating elements 25, an upper heating element (in the upper section or half of the tank 17) and a lower heating element (in the lower section or half of the tank 17). Other numbers and locations of heating elements may be used in other embodiments. Activation/deactivation of each heating element 25 is controlled, in part, by a respective relay 45. FIG. 1 depicts two such relays, one for controlling the upper heating element 25 and the other for controlling the lower heating element 25. The relays 45 receive power from an AC power source (not shown) using power wire pair 39, where the voltage across the wire pair in one embodiment is generally around 220 V AC.

Each respective relay 45 is controlled by a control signal, generally a low voltage, provided by the controller 28. The relay 45 has a coil (not shown), sometimes called a winding, that provides a magnetic force for closing contacts of the relay. When a control current from the controller 28 flows in the coil of the relay, the contacts of the relay are in a closed position and current flows to the heating element 25. Generally, each of the relays 45 of FIG. 1 is independently turned off or on so as to independently provide current to each of the heating elements 25. The switching function of the relay may be provided in other embodiments by solid-state relays, SCRs, and other relay devices known to those skilled in the art.

The controller 28 can have a user interface capable of providing information about the water heating system 100 and in addition enabling a user to provide commands or information to the controller 28. An exemplary controller 28 is described in U.S. patent application Ser. No. 10/772,032, entitled "System and Method for Controlling Temperature of a Liquid Residing within a Tank," which is incorporated herein by reference. The controller 28 can process both user and sensor input using a control strategy for generating control signals, which independently control the relays 45 and hence the activation and deactivation of the heating elements 25. The controller 28 may be implemented in hardware, software, or a combination thereof.

Figure 2:
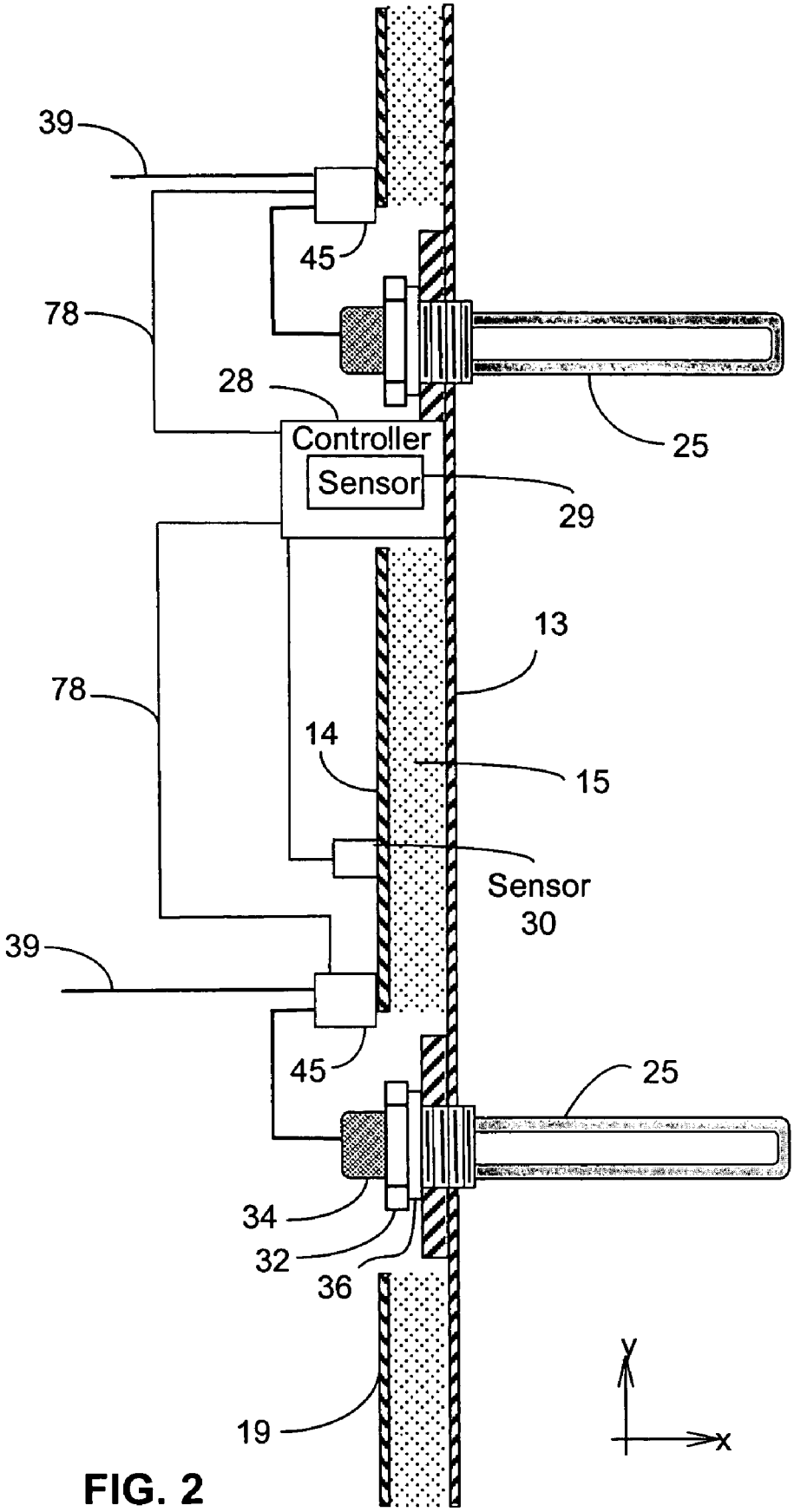
FIG. 2 illustrates heating elements and a controller mounted on a water tank of the water heating system depicted in FIG. 1.

FIG. 2 illustrates an exemplary arrangement comprising two heating elements 25 utilized to heat water contained in the tank 17 of the water heating system 100 of FIG. 1. The tank 17 is comprised of a cylindrical container having a container wall 13 for holding water, a cylindrical shell 19 that surrounds the cylindrical container and insulation 15 therebetween. Each heating element 25 extends through a hole passing through the wall 13, insulation 15, and shell 19. Each heating element 25 also has a connector block 34 for receiving power, a seal 36 and a hexagonal-shaped head for receiving a wrench. The connector block 34 has two terminals that are connected to output terminals of a respective relay 45, which has two input ports, one for receiving power, such as 220 V AC, and the other for receiving a control signal. The controller 28 has a control line 78 for each relay 45. The heating element 25 nearest to the controller 28 and in the upper section of the tank 17 in FIG. 2 will be referred to as the "upper" heating element 25, and the other heating element 25 (in the lower section of the tank 17) in FIG. 2 will be referred to as the "lower" heating element 25.

Figure 3:
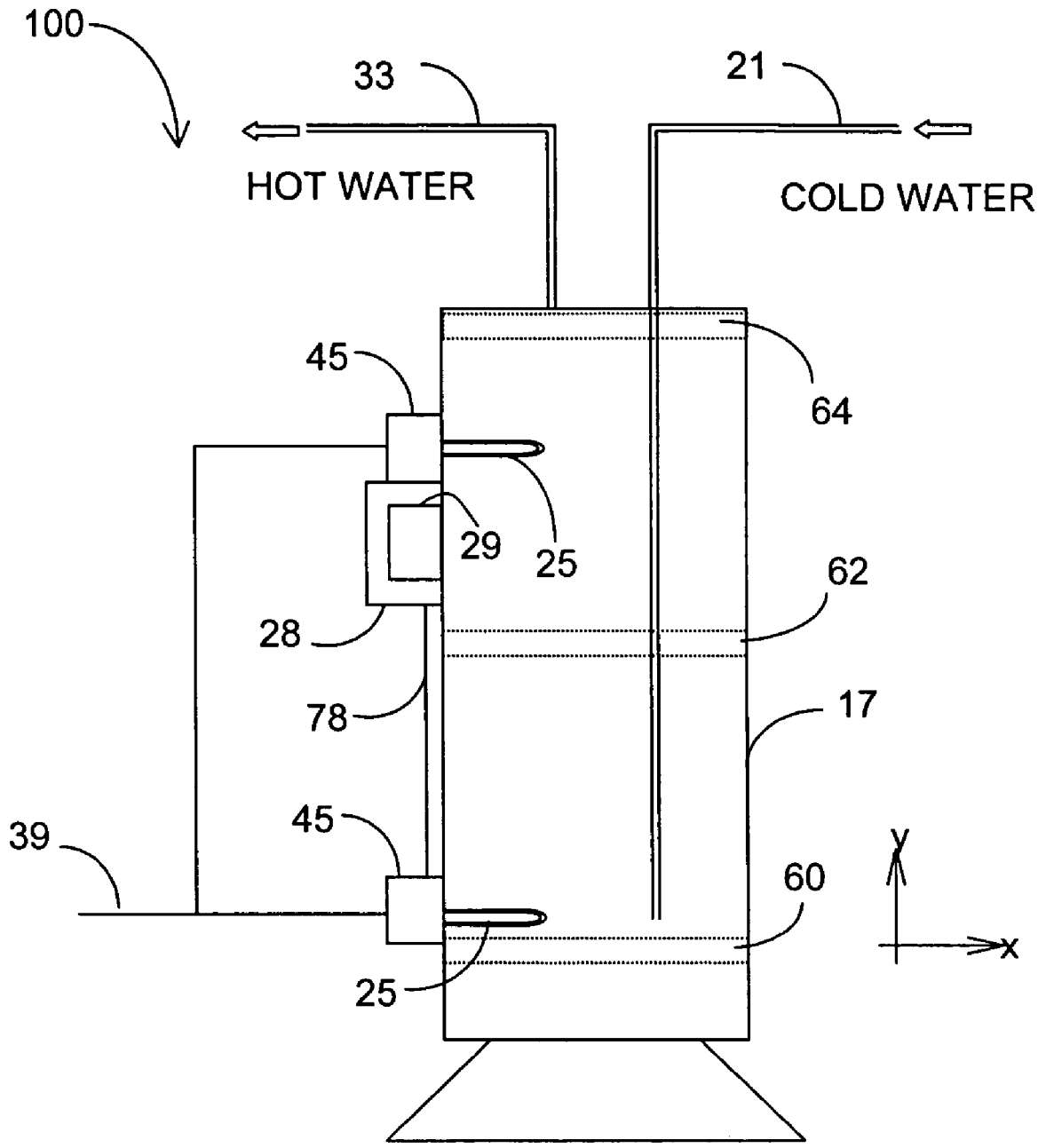
FIG. 3 illustrates a stacking temperature profile for the system of FIG. 1.

FIG. 3 illustrates the system 100 of FIG. 1 with three temperature layers to illustrate stacking. Generally, warmer water is less dense and, therefore, rises. Thus, the temperature of the water within the tank 17 generally increases in the positive y-direction with warm water at the bottom and hot water at the top. For example, the water in layer 60 in the bottom section of the tank 17 may have a temperature of Ta, the water in layer 62 in the middle section of the tank 17 may have a temperature of Tb, and water in layer 64 in the upper section of the tank may have a temperature of Tc. Because water density generally decreases with an increase in temperature, the temperature Tc is likely to be greater than Tb, and Tb is likely to be greater than Ta.

As will be described in more detail hereafter, it is generally desirable to control activation/deactivation of the upper heating element 25 via a temperature sensor located at a close proximity to the upper heating element 25 and to control activation/deactivation of the lower heating element 25 via a temperature sensor located at a close proximity to the lower heating element 25. If a small amount of hot water is drawn from the tank 17 via hot water pipe 33, it is possible for the temperature measured by the temperature sensor for the lower heating element 25 to fall below the lower set point for the lower heating element 25. In this regard, the cold water that is being introduced at the bottom of the tank 17 for replenishing the small amount of hot water drawn from the tank 17 may cause the measured temperature to fall below the lower set point. Thus, the lower heating element 25 may be activated even though a significant amount of hot water is not drawn from the tank 17.

If cycles of small water usage repetitively occur within a short time period, the lower heating element 25 may be repetitively activated. The water heated by the lower heating element 25 during each activation or heating cycle will rise as its temperature increases, yet the repeating cycles of small water usage may not, overall, withdraw a significant amount of hot water from the top of the tank 17. Thus, water heated by the repetitive activation cycles of the lower heating element 25 tends to accumulate or "stack" at the top of the tank 17 further increasing the temperature of the hot water at the top of the tank 17. Due to such stacking, the temperature of the water at the top of the tank 17 may reach significantly high temperatures that are well above the upper set point of either or both of the heating elements 25.

The controller 28 in FIG. 3 preferably implements a control algorithm to help reduce the high temperatures at the top of the tank caused by stacking. In one embodiment, the controller 28 has an embedded temperature sensor 29 to sense water temperature, and the controller 28 uses readings from the temperature sensor 29 to control at least one of the heating elements 25 to reduce the effects of stacking, as will be described in more detail below. In other embodiments, the controller 28 may receive temperature readings from an external temperature sensor that is mounted on a side of the tank 17 or other suitable location for sensing the temperature of the water within the tank 17.

In one embodiment, the controller 28 controls the operation of both the upper heating element 25 and the lower heating element 25. In the embodiment depicted by FIG. 2, the controller 28 and, therefore, sensor 29 are mounted close to the upper heating element 25. Thus, the controller 28 uses temperature readings from the sensor 29 to control the operation of the upper heating element 25. In other embodiments, the controller 29 may use readings from other temperature sensors to control the upper heating element 25.

The controller 28 compares the temperature sensed by the temperature sensor 29 to an upper threshold, referred to as the "upper set point," and a lower threshold, referred to as the "lower set point," associated with the upper heating element 25. If the sensed temperature is below the lower set point, the controller 28 activates the upper heating element 25 so that it begins to heat the water within the tank 17. In particular, the controller 28 transmits, to the relay 45, referred to as the "upper relay," that supplies power to the upper heating element 25, a control signal for deactivating the upper heating element 25. In this regard, the control signal places the upper relay 45 in a closed state so that the upper relay 45 provides power to the upper heating element 25 thereby activating the upper heating element 25.

The upper heating element 25 remains in an activation state until the temperature sensed by the sensor 29 reaches or exceeds the upper set point. Once this occurs, the controller 28 transmits, to the upper relay 45, a control signal for deactivating the upper heating element 25. In this regard, the control signal places the upper relay in an open state so that power is not provided to the upper heating element 25 thereby deactivating the upper heating element 25. The aforedescribed process is repeated in an effort to keep the temperature of the water within the tank 17 between the upper and lower set points.

A similar process is performed by the controller 28 for controlling the lower heating element 25 in normal operation. In this regard, an upper set point and a lower set point is specified for the lower heating element 25, and the controller 28 compares sensed water temperatures to these set points to activate the lower heating element 25 (if the sensed temperature is below the lower set point) and to deactivate the lower heating element 25 (if the sensed temperature is at or above the upper set point). Since the temperature of the water within the tank 17 can vary significantly from top to bottom, the controller 28 preferably uses temperatures sensed from a temperature sensor 30 close to the lower heating element 25 for controlling the lower heating element 25, as shown by FIG. 2.

Note that, in other embodiments, the controller 28 may use temperature sensors mounted in locations other than that shown for sensor 30 in FIG. 2 to control the lower heating element 25. Indeed, it is possible for the controller 28 to control both the upper and lower heating elements 25 based on a single temperature sensor. In addition, it is possible for the upper and lower set points for both the upper and lower heating elements 25 to be the same. Alternatively, different upper and lower set points can be specified for the upper and lower heating elements 25.

To reduce the effects of stacking, the controller 28 preferably detects a stacking condition and disables the lower heating element 25 in response to the detected stacking condition. A "stacking condition" refers to a condition in which the water at the top of the tank 17 has become significantly overheated due most likely to the stacking phenomena discussed above. To detect a stacking condition, a temperature threshold, referred to as the "stacking threshold" or "TS" is specified and stored in the controller 28. The stacking threshold is preferably significantly higher than the upper set point used to control the upper heating element 25 so that a stacking condition is likely if the stacking threshold is exceeded by the temperature sensed by the sensor 29.

When the controller 29 detects a stacking condition, the controller 28 disables the lower heating element 25. In one embodiment, the controller 28 disables the lower heating element 25 by transmitting, to the relay 45, referred to as the "lower relay," that supplies power to the lower heating element 25, a control signal for deactivating the lower heating element 25. The control signal places the lower relay 45 in an open state so that power is not supplied to the lower heating element 25 thereby deactivating the lower heating element 25. Note that the lower heating element 25 is disabled regardless of the temperature sensed by the lower temperature sensor 30. Thus, when a stacking condition is detected, the lower heating element 25 is disabled even if the temperature sensed by the lower sensor 30 is below the lower set point that is used to control the lower heating element 25.

The controller 28 preferably keeps the lower heating element 25 disabled until the temperature sensed by the upper sensor 29 falls below another specified threshold, referred to herein as the "release threshold" or "TR." The release threshold is preferably set close to or below the upper set point that is used to control the upper heating element 25. Thus, the lower heating element 25 will not be enabled until the temperature of the water at the top of the tank 17 falls back to a normal range. Moreover, by disabling the lower heating element 25 in response to a detection of a stacking condition, the controller 28 prevents further heating of the water until the temperature of the water within the tank 17 falls back to a normal range, at which point the controller 28 can resume normal operation. Specifically, the controller 28 can enable the lower heating element 25 such that it is activated if the temperature sensed by the lower sensor 30 is below the lower set point for this heating element 25.

Figure 4:
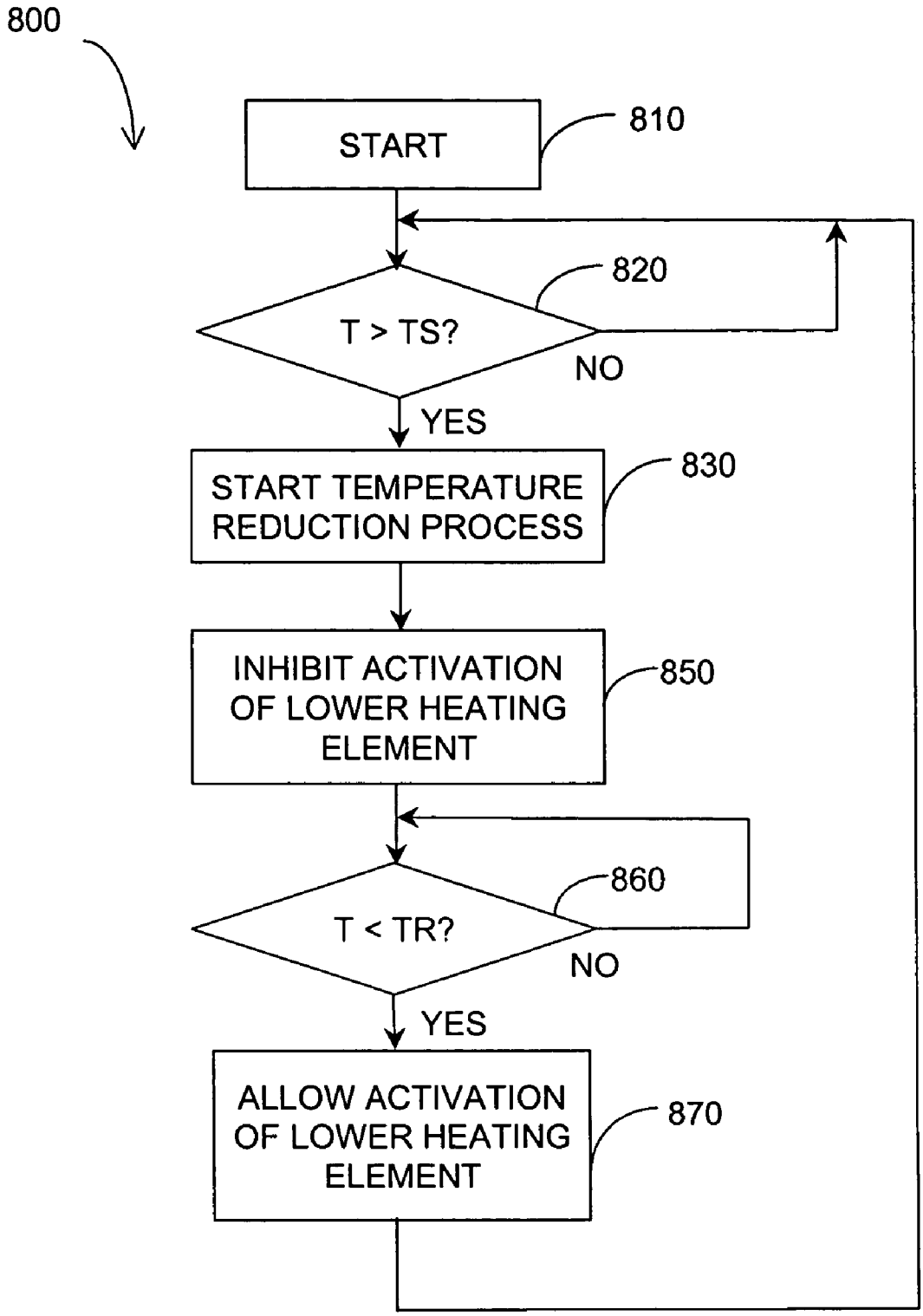
FIG. 4 depicts a flow chart illustrating an exemplary methodology for reducing the effects of stacking for the system of FIG. 1.

FIG. 4 is a flow chart showing an exemplary methodology 800 for detecting and reducing the effects of stacking. The methodology 800 is initiated at the start step 810. Temperature, T, sensed by the sensor 29 is compared to the stacking threshold, TS. If T is greater than TS, then the controller 28 initiates a temperature reduction process. When the temperature reduction process is started, a control signal is generated by the controller 28 for inhibiting the activation of the lower heating element 25. When the control signal is transferred over control line 78 to the lower relay 45 or other control element of the lower heating element 25, the lower heating element 25 is prohibited from receiving power, step 850. The controller 28 continues to receive temperature values from the sensor 29 and compares such values with the release temperature (TR), step 860. When T is greater than or equal to TR, the controller 28 via transmission of a disabling control signal to the lower relay 45 prevents the lower heating element 25 from activating. When T is less than TR, then the controller 28 allows activation of the heating element, step 870.

Note that when power is applied to upper heating element 25, the water surrounding this heating element 25 is heated and has a corresponding increase in temperature. When the sensor 29 is not mounted within the tank 17, such as when the sensor 29 is mounted on an outside wall of the tank 17, as shown in FIG. 2, it takes time for the sensor 29 to detect a temperature change of the water within the tank 17. As an example, it may take several minutes before the sensor 29 senses a rise in water temperature resulting from heat supplied by the upper heating element 25. Such a delay is referred to as "thermal lag" or simply "lag".

In a preferred embodiment, the controller 28 is configured to compensate for thermal lag. In this regard, the controller 28 is configured to analyze at least one heating cycle of activating and deactivating the upper heating element 25 to estimate a parameter indicative of thermal lag. Then, the controller 28 is configured to adjust its control algorithm of the upper heating element 25 to compensate for thermal lag.

For example, after deactivating the upper heating element 25 in response to a determination that the sensor 29 has detected a temperature exceeding the upper set point, the controller 28 continues to monitor the temperatures sensed by the sensor 29. Due to thermal lag, the temperatures sensed by the sensor 29 will continue to rise above the upper set point after deactivation of the upper heating element 25. Such a phenomena occurs because, due to thermal lag, the actual water temperature exceeded the upper set point well before the temperature sensed by the sensor 29 exceeded the upper set point. Thus, the upper heating element 25 continued heating the water after actual water temperature exceeded the upper set point. Moreover, the controller 28 preferably determines the maximum temperature detected by the sensor 29 after deactivation of the upper heating element 25. The difference between the maximum temperature and the upper set point will be referred to as the "lag difference."

For a future heating cycle, the controller 28 can be configured to subtract the lag difference from the upper set point to determine a new upper set point. The controller 28 then deactivates the upper heating element 25 in response to a detection of a temperature by sensor 29 at or above the new upper set point. As a result, the upper heating element 25 is deactivated earlier in the heating cycle, and the maximum temperature of the water reached for this heating cycle will likely be closer to the original upper set point.

In another embodiment, the controller 28 can be configured to use time values rather than temperature values to compensate for thermal lag. For example, the controller 28 may determine the amount of time, referred to as "heating duration," between activation and deactivation of the upper heating element 25 for a heating cycle. The controller 28 may also detect an amount of time, referred to as "lag time," that elapses between the deactivation of the upper heating element 25 and a detection of the maximum temperature sensed after deactivation of the upper heating element 25. The controller 28 may subtract the lag time from the heating duration to provide an amount of time, referred to as the "new heating duration." Then, upon activating the upper heating element 25 for the next heating cycle, the controller 28 may be configured to deactivate the upper heating element 25 upon expiration of the new heating duration regardless of the temperature values measured by the sensor 29.

It should be noted that controller 28 may be configured to adjust its control algorithms depending on the rate of temperature change of the water within the tank 17. In this regard, due to various factors, such as differences in the amount of water drawn during different heating cycles, it is possible for different heating cycles to result in different rates of temperature changes. As an example, assume that the controller 28 determines a lag difference for a first heating cycle, referred to as the "calibration heating cycle." During the calibration heating cycle, the controller 28 also determines the rate of temperature change measured by the sensor 29 as the upper heating element 25 is heating the water within the tank 17. Instead of just subtracting the lag difference from the upper set point to determine the new upper set point for a subsequent heating cycle, the controller 28 may monitor the change in temperature detected by the sensor 29 as the upper heating element 25 is heating water during the subsequent heating cycle. If the rate of temperature change for the subsequent heating cycle is significantly different than the rate of temperature change for the calibration heating cycle, then the controller 28 may be configured to adjust the lag difference before determining the new upper set point for the subsequent heating cycle.

For example, if the rate of temperature change for the subsequent heating cycle is significantly less than that of the calibration heating cycle, then the controller 28 may be configured to decrease the lag difference before subtracting it from the original upper set point for determining the new upper set point. However, if the rate of temperature change for the subsequent heating cycle is significantly greater than that of the calibration heating cycle, then the controller 28 may be configured to increase the lag difference before subtracting it from the original upper set point for determining the new upper set point.

There are various methodologies that may be used to control the operation state of the upper heating element 25 to account for thermal lag, and there are various other methodologies that may be used to account for variations in the rates of temperature changes for different heating cycles.

For the purposes of illustration, thermal lag has been discussed above in the context of upper heating element 25. However, it will be appreciated to those of ordinary skill in the art that similar methodologies may be applied to the lower heating element 25, or any other heating elements within the system 100.

Figure 5:
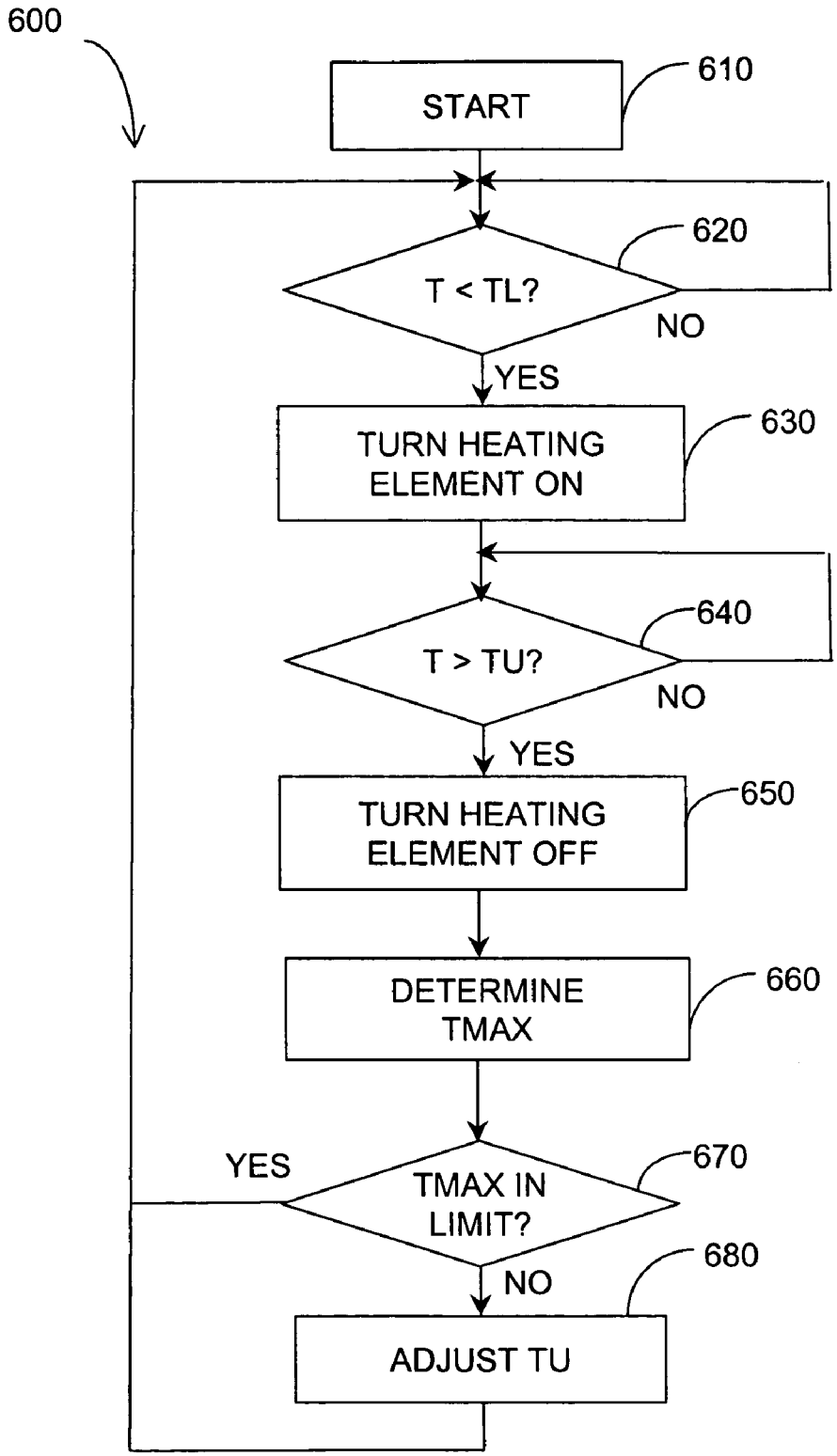
FIG. 5 depicts a flow chart illustrating an exemplary methodology for reducing the effects of temperature lag for the system shown in FIGS. 1 and 5.

FIG. 5 is a flow chart showing an exemplary methodology 600 for reducing the a temperature overshoot caused by thermal lag. For illustrative purposes, the methodology will be discussed in the context of upper heating element 25. However, the same methodology 600 may be used for the lower heating element 25 as well.

The method is started at step 610. As indicated by step 620, if the temperature T detected by the sensor 29 is less than the lower set point, TL, for the upper heating element 25, then the controller 28 generates a control signal, step 630, for activating the upper relay 45 and applying power to the upper heating element 25. The temperature, T, is monitored, step 640, and compared to the upper set point, TU, for the upper heating element 25. When T is greater than TU, the upper heating element 25 is deactivated, step 650. After the upper heating element 25 no longer receives power, the sensor 29 continues to detect a rise in temperature, T. The controller 28 determines and stores the maximum temperature, TMAX, detected by the sensor 29. If TMAX is within a specified limit, i.e., the maximum temperature is within a set tolerance of the upper set point, then the controller 28, at step 670, determines to return to step 620 and begins monitoring the temperature sensor 29 for the next heating cycle. If TMAX is not in the limit, then the controller 28 adjusts TU based on the current value of TU and the value of TMAX. In one embodiment, a new value for TU is determined by subtracting a portion (e.g., one half) of the quantity (TMAX-TU) from TU. For example if TU is 110 and TMAX is 120, then the new value for TU is 105.

Figure 6:
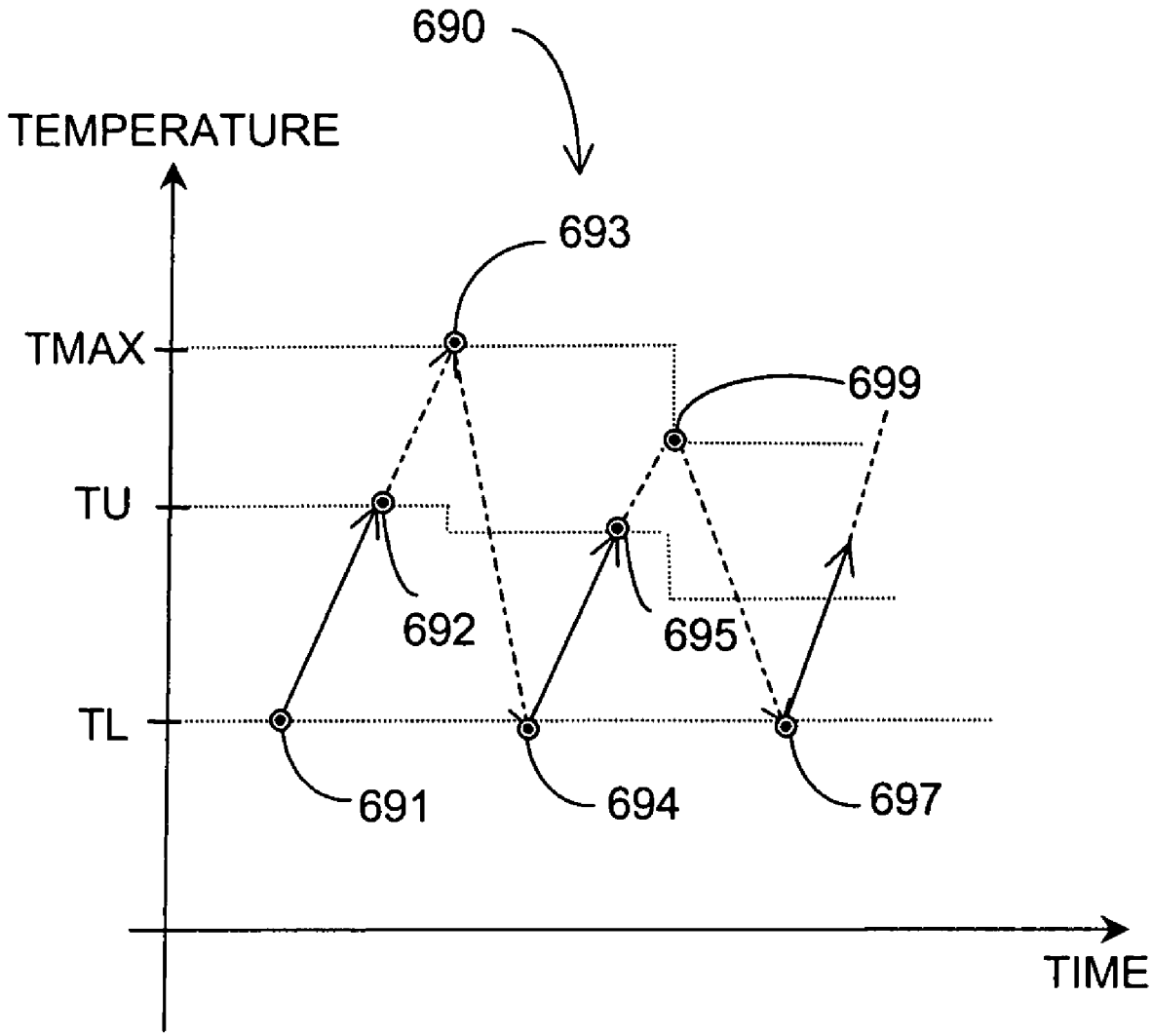
FIG. 6 illustrates a temperature transition diagram depicting exemplary temperature profiles based on the methodology of FIG. 6.

A method for reducing high temperatures caused by thermal lag is depicted in the time transition diagram of FIG. 6. When the temperature is equal to TL, shown by point 691, the upper heating element 25 is activated and the temperature, T, increases with time. When the temperature, as sensed by the sensor 29, reaches the value TU, shown by point 692, then the upper heating element 25 is deactivated. However the temperature detected by the sensor 29 continues to increase and reaches a maximum value, TMAX, as shown by point 693. As hot water is used and cold water enters the hot water tank and/or as thermal losses begin to affect water temperature, the temperature continues to decrease until T reaches the lower set point temperature, TL, shown by point 694. Upon detection of TMAX, a new value of TU is provided in step 680 of FIG. 5 assuming that TMAX is in the limit, as described in the previous paragraph. Hence, there is a decrease in the value of TU when TMAX occurs. The process continues as shown by points 695, 696 and 697 on the temperature transition diagram of FIG. 6.

It should be emphasized that the above-described embodiments of the present invention are merely possible examples of implementations and set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

Now, therefore, the following is claimed:

1. A water heating system, comprising:

a tank;

a first heating element mounted on the tank;

a first temperature sensor;

a second temperature sensor; and a controller electrically coupled to the first and second temperature sensors, the controller configured to detect a stacking condition in response to a determination that a temperature sensed via the first temperature sensor exceeds a first threshold and to compensate for the stacking condition, in response to detection of the stacking condition, by disabling the first heating element until a temperature sensed via the first temperature falls below at least the first threshold, the controller further configured to control operation of the first heating element based on the second temperature sensor.

2. The system of claim 1, wherein the controller is configured to compensate for the stacking condition, in response to the detection of the stacking condition, by disabling the heating element until a temperature sensed via the first temperature sensor falls below a second threshold, wherein the second threshold is lower than the first threshold.

3. The system of claim 1, wherein the controller, in compensating for the stacking condition, is configured to ensure that the heating element remains disabled, based on the first temperature sensor, until a temperature sensed via the first temperature sensor falls below at least the first threshold regardless of temperatures being sensed via the second temperature sensor while the heating element is disabled in response to the detection of the stacking condition.

4. The system of claim 1, wherein the controller is configured to deactivate the heating element in response to a determination that a temperature sensed via the second temperature sensor exceeds a second threshold, wherein the first threshold is higher than the second threshold.

5. A water heating system, comprising:

a tank;

a first heating element mounted on the tank;

a first temperature sensor;

a second heating element;

a second temperature sensor; and a controller electrically coupled to the first temperature sensor, the controller configured to detect a stacking condition based on the first temperature sensor and to disable the first heating element in response to detection of the stacking condition, the controller further configured to control operation of the second heating element based on the first temperature sensor and configured to control operation of the first heating element based on the second temperature sensor.

6. The system of claim 5, wherein the tank has an upper section and a lower section, and wherein the first heating element is mounted on the tank in the lower section of the tank, and wherein the second heating element is mounted on the tank in the upper section of the tank.

7. The system of claim 5, wherein the controller is configured to activate the first heating element if a temperature sensed by the second temperature sensor is below a lower set point for the first heating element and to deactivate the first heating element if a temperature sensed by the second temperature sensor is above an upper set point for the first heating element.

8. The system of claim 7, wherein the controller is configured to disable the first heating element in response to the detection of the stacking condition regardless of the temperature sensed by the second temperature sensor.

9. The system of claim 7, wherein the controller is configured to enable the first heating element if a temperature sensed by the first temperature sensor is below a threshold, and wherein the threshold is higher than the lower set point.

10. A method for use in a water heating system, comprising the steps of:

sensing a temperature via a first temperature sensor mounted on a tank;

determining whether the sensed temperature exceeds a first threshold;

detecting a stacking condition in response to the determining step;

disabling a heating element mounted on the tank in response to the detecting step until a temperature sensed via the first temperature sensor falls below a second threshold; and controlling operation of the heating element based on a second temperature sensor mounted on the tank.

11. The method of claim 10, wherein the controlling step comprises the step of deactivating the heating element in response to a determination that a temperature sensed via the second temperature sensor is above a third threshold, and wherein the disabling step is performed independent of the second temperature sensor.

12. The method of claim 11, wherein the first threshold is higher than the third threshold.

13. A method for use in a water heating system, comprising the steps of:

sensing a temperature via a first temperature sensor mounted on a tank;

detecting a stacking condition based on the first temperature sensor;

disabling a first heating element mounted on the tank in response to the detecting step;

controlling operation of a second heating element mounted on the tank based on the first temperature sensor; and controlling operation of the first heating element based on a second temperature sensor mounted on the tank.

14. The method of claim 13, wherein the controlling operation of the first heating element step comprises the steps of:

activating the first heating element if a temperature sensed by the second temperature sensor is below a lower set point for the first heating element; and deactivating the first heating element if a temperature sensed by the second temperature sensor is above an upper set point for the first heating element.

15. The method of claim 14, wherein the disabling step is not based on the second temperature sensor.

16. The method of claim 14, further comprising the step of enabling the first heating element if a temperature sensed by the first temperature sensor is below a threshold, wherein the threshold is higher than the lower set point.

17. A method for compensating for a stacking condition within a water heating system, comprising the steps of:

sensing a temperature via a first temperature sensor mounted on a tank;

detecting a stacking condition based on whether the temperature exceeds a first threshold;

deactivating a heating element mounted on the tank based on whether a temperature sensed via a second temperature sensor mounted on the tank exceeds a second threshold; and compensating for the stacking condition in response to the detecting step, wherein the compensating step comprises deactivating the heating element regardless of a temperature being sensed via the second temperature sensor.

18. The method of claim 17, wherein the disabling is not based on the second temperature sensor.

19. The method of claim 17, wherein the first threshold is higher than the second threshold.

20. A method for compensating for a stacking condition within a water heating system, comprising the steps of:

sensing a temperature via a first temperature sensor mounted on a tank;

disabling a first heating element mounted on the tank based on whether the temperature exceeds a threshold;

deactivating the first heating element based on a second temperature sensor mounted on the tank; and deactivating a second heating element mounted on the tank if a temperature sensed by the first temperature sensor exceeds an upper set point for the second heating element.

21. The method of claim 20, wherein the threshold is higher than the upper set point.

22. A system, comprising:

a tank;

a heating element mounted on the tank;

at least one temperature sensor; and a controller electrically coupled to the temperature sensor, the controller configured to deactivate the heating element in response to a determination that a temperature sensed by the at least one temperature sensor exceeds an upper set point for the heating element, the controller configured to monitor, after deactivating the heating element in response to the determination, temperatures sensed by the at least one temperature sensor above the upper set point to determine an effect of thermal lag to the monitored temperatures, the controller further configured to compensate for thermal lag by adjusting the upper set point based on the determined effect.

23. The system of claim 22, wherein the controller is configured to determine a value indicative of a difference between one of the monitored temperatures and the upper set point and to adjust the upper set point based on the value.

* * * * *